United States Patent [19]

Grundy

[11] 3,999,483

[45] Dec. 28, 1976

[54] REMOVING COATINGS FROM PIPE

[75] Inventor: Charles D. Grundy, Grapevine, Tex.

[73] Assignee: Jet Research Center, Inc., Arlington, Tex.

[22] Filed: July 30, 1975

[21] Appl. No.: 600,744

[52] U.S. Cl. ..... 102/23; 102/27 R

[51] Int. Cl.[2] ..... F42D 7/00

[58] Field of Search ..... 102/21, 22–24, 102/27 R

[56] References Cited

UNITED STATES PATENTS

| | | | |
|---|---|---|---|
| 2,259,564 | 10/1941 | Holland | 102/21 |
| 3,374,737 | 3/1968 | Pike | 102/27 R |
| 3,789,759 | 2/1974 | Jones | 102/23 |

*Primary Examiner*—Verlin R. Pendegrass
*Attorney, Agent, or Firm*—Thomas R. Weaver; John H. Tregoning

[57] ABSTRACT

A method and an article of manufacture useful in the method are provided for removing a fracturable coating, such as concrete, from a conduit, such as an underwater pipeline. According to the method a plurality of spaced explosive detonating cords are placed against the portion of the coating to be removed. Upon detonation of the explosive detonating cords the coating is sufficiently fractured to enable its convenient removal from the conduit by a diver but the conduit is only very slightly damaged, if at all, by the explosion.

16 Claims, 13 Drawing Figures

REMOVING COATINGS FROM PIPE

Figure 1:
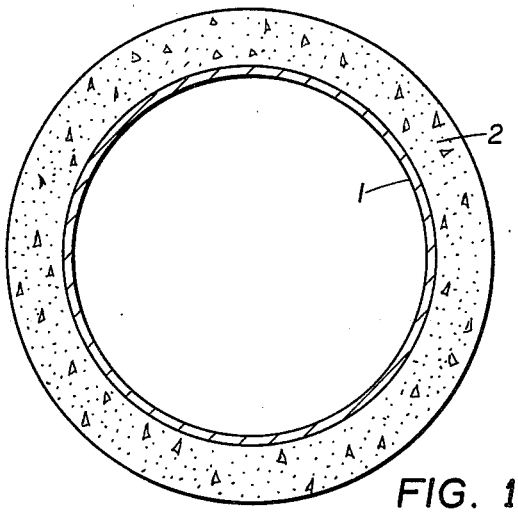

This invention relates to the use of explosives in construction operations. It further relates to the removal of coatings from conduits with explosives. This invention still further relates to the removal of an applied coating, such as concrete, from a conduit, such as casing, with an article of manufacture comprised of explosive detonating cord.

Under certain conditions of use, it becomes necessary to encase a conduit, such as a metal pipe, in a hardenable mass of material, such as cement or concrete, whereby the conduit becomes covered with a sheath of the hardened material. One specific example of a use which necessitates the application of such a sheath arises during the construction of a pipeline wherein at least a portion of the pipeline is to be installed underwater or in an area subject to flooding or in any area having a high water table such as a swamp.

The use of concrete as a coating for pipe in pipeline construction operations is well known as a method for imparting negative bouyancy to pipe installed underwater. The weight of the concrete coating compensates for the weight of water displaced by the volume of the pipe; therefore, by means of well known calculations, the weight of the volume of displced water is determined and concrete having a weight at least equal to the weight of displaced water is attached to the pipe to prevent the pipe and its contents from floating.

A method for attaching the necessary weight of concrete to the pipe has been to apply the hardenable concrete as a coating of substantially constant thickness to the exterior surface of the pipe prior to installation of the pipe under the water, wherein the coating thickness is a function of the weight required.

In addition to providing negative bouyancy, the weight provided by the concrete also contributes to the resistance of the installed pipeline to movement caused by wave action, flooding and the like. Other uses and advantages afforded by such coated pipe are well known to those skilled in the art.

Those skilled in the art are also well aware of the disadvantages associated with the use of pipe having, for example, a concrete coating thereon. One such disadvantage and problem resides in the task of removing the coating from the pipe. On those occasions presenting a need to cut into the pipe itself to effect repairs, make connections, install valves and the like, the cutting of the pipe must be preceeded by removal of the coating therefrom. The removal of the coating must be conducted in a manner which will not, or which will at least diminish, damage done to the pipe itself. Where the pipe having the coating to be removed is installed in water, particularly in deep water, the problems of removal are increased. In water where divers must be used to service underwater pipelines, the removal problem becomes quite severe. The physical force employable by a diver to remove the coating and the time which the diver can actually spend in the water are both limited.

Accordingly, by this invention there is provided a process and an article of manufacture which is particularly suitable for removing coatings, such as concrete, which sheath the exterior surface of a pipe. The article is particularly useful to remove concrete coatings from pipelines, or portions thereof, which are situated in underwater locations wherein the services of divers are relied upon to perform the removal work.

According to the process of the invention, a plurality of explosive detonating cords, maintained in spaced relationship are placed against the portion of the pipe coating to be removed. The detonating cords are connected to an initiating device and detonated. Upon detonation the explosive force generated by the virtual simultaneous explosion of the plurality of detonating cords causes the concrete sheath to either shatter or sufficiently crack and chip to permit its convenient removal from the pipe, but the force of the detonation is not sufficient to collapse or otherwise severely damage the pipe. The quantity of explosive required, expressed in terms of size and number of explosive detonating cord, is a function of the nature of the pipe, its diameter and wall thickness, and the coating type and thickness; if the pipe is underwater, the pressure of the water, due to water depth, should also be considered when determining the quantity of explosive.

The particular pattern of placement of the plurality of detonating cords on the pipe coating is not believed to be of critical importance, that is, the individual cords can be crosslapped to form a grid or can be placed in parallel rows. Even though the pattern of placement is not considered of critical importance to the process above described, the article of manufacture described hereinafter features placement of the explosive detonating cord in essentially parallel rows. Accordingly, this invention is considered to include within its scope any article which can function to maintain a plurality of explosive detonating cords in substantially fixed spaced relationship one to another during placement of the plurality of cords against the coating to be removed.

Figure 2:
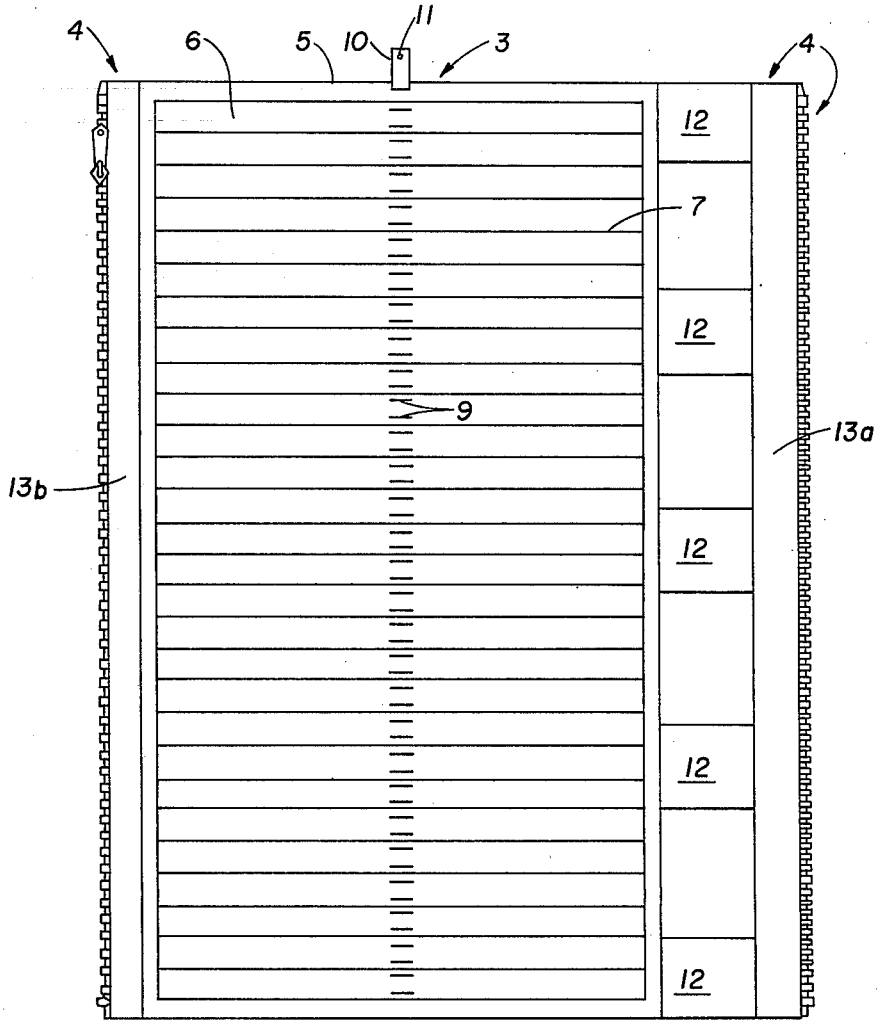
Figure 3:
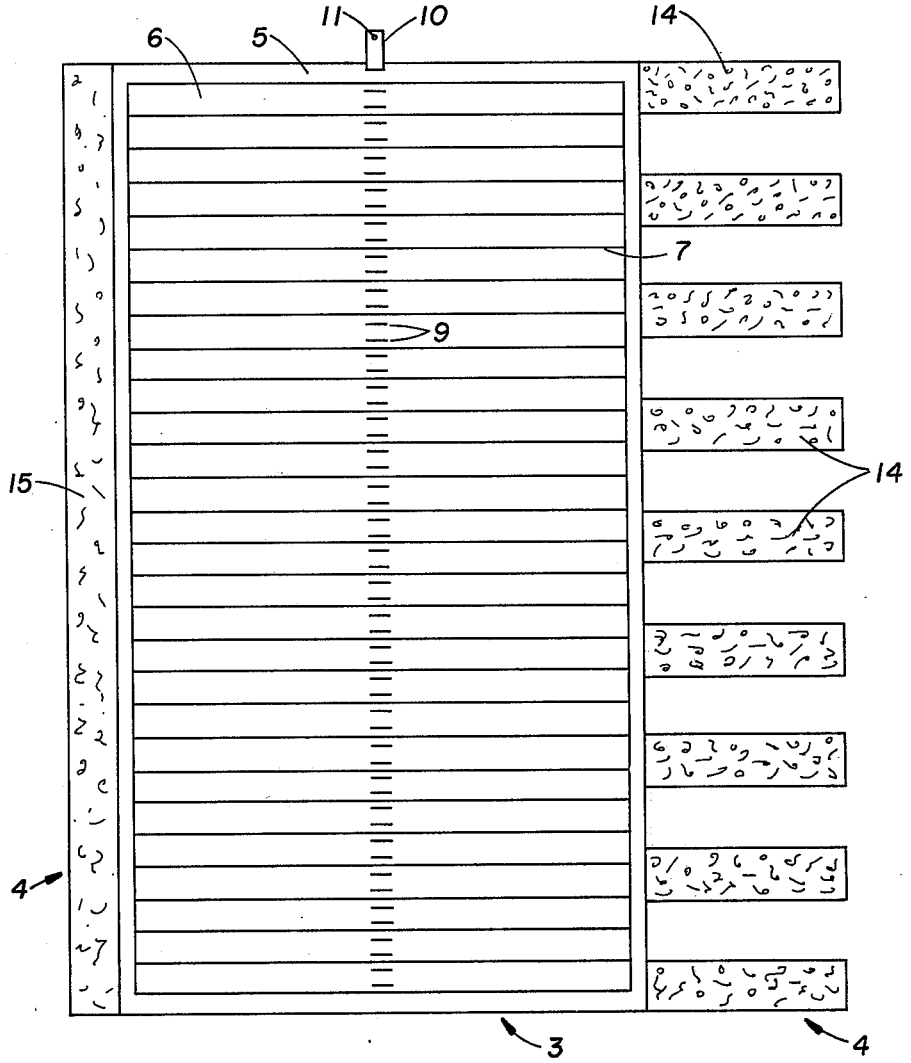
Figure 5:
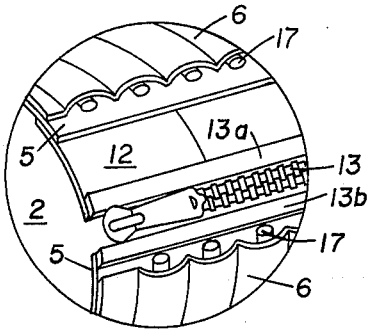
Figure 4:
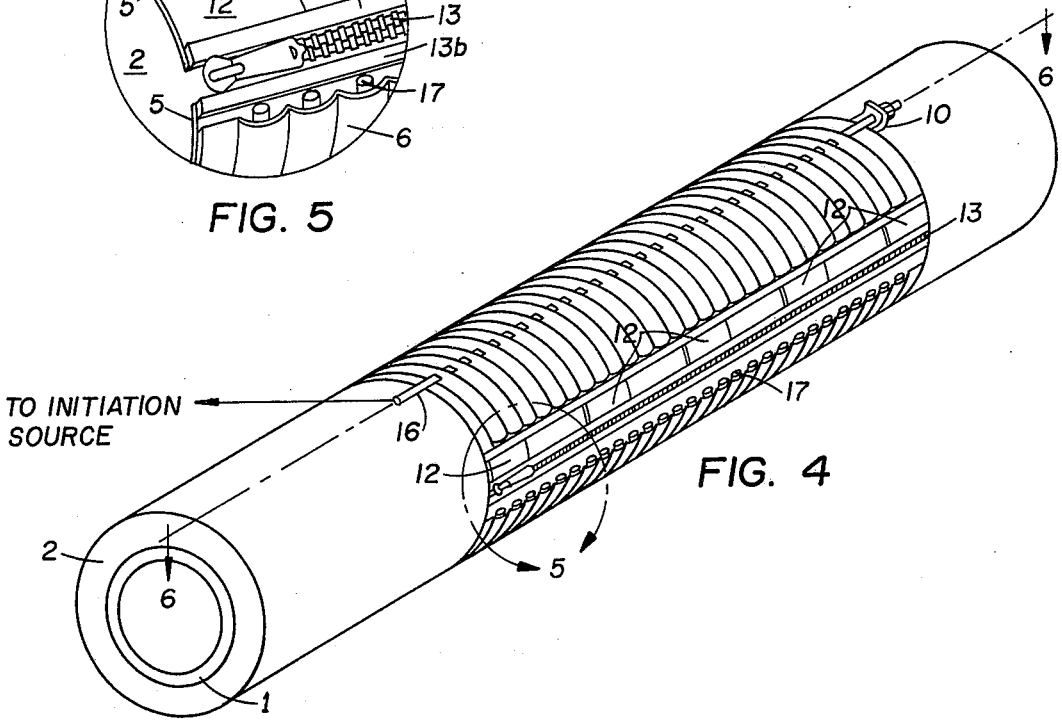
Figure 6:
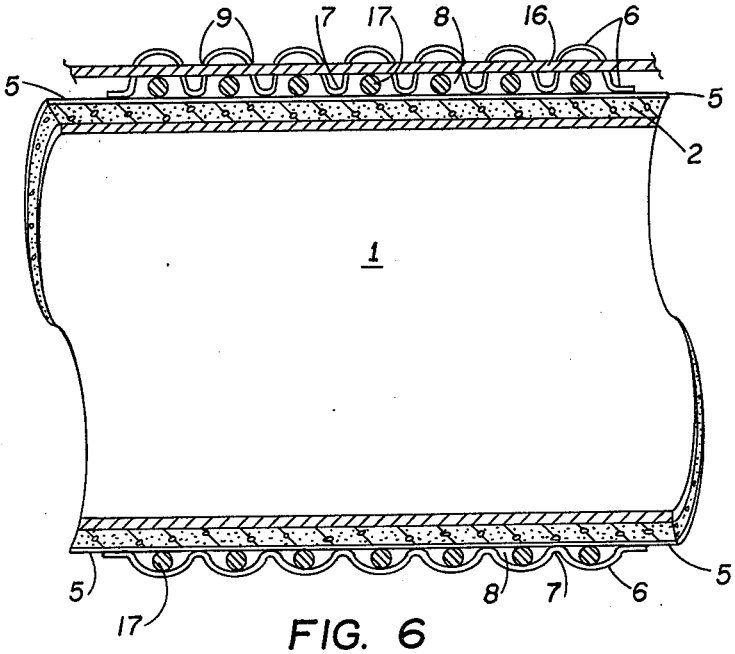

The process and article of manufacture of this invention are further described in connection with the appended FIGS. 1–7 which include:

FIG. 1 indicating a pipe having a coating to be removed;

FIG. 2 indicating the top view of one embodiment of the article of manufacture of this invention;

FIG. 3 indicating the top view of a second more preferred embodiment of the article of manufacture of this invention;

FIG. 4 indicating a perspective view of the article of manufacture of this invention installed on the pipe of FIG. 1;

FIG. 5 indicating a detail view of a portion of FIG. 4;

FIG. 6 indicating a cross-sectional view of FIG. 4; and

FIGS. 7*a* through 7*g* indicating a series of steps comprising the use of the article of manufacture of this invention to remove a section of a pipe.

Referring now to FIG. 1, a section view is shown of a pipe 1 encased by a hardened mass of concrete 2 which is to be removed according to the process of this invention. The pipe can be of any material, although, conventionally, pipe material ordinarily associated with the use of this invention is a metal such as steel. The wall thickness and diameter of pipe 1 can be selected from any of those having values commensurate with the particular use contemplated for the pipe. Although pipe of any diameter can be treated according to this invention, it is believed that pipe having a nominal diameter in the range of from about 12 to about 48 inches can be very efficiently and effectively treated by the process of this invention.

The coating 2, to be removed from pipe 1, has been described as being comprised of concrete. This invention is not limited to the removal of concrete coatings; however, those coatings having the approximate shattering properties of concrete when subjected to localized high compressive forces are readily removed by the process of this invention. Also, the coating to be removed can be comprised of layers of differing materials. For example, a pipe coating consisting of an inner layer of a bituminous material, such as tar, asphalt or the like, and an outer layer of cement or concrete can be successfully removed by this invention. That is, both inner and outer layers can be removed from the pipe by the process of this invention.

The thickness of coating 2 is not a deterent to the practice of this invention. The thickness of coating 2, however, should be considered when the quantity of explosive is selected for a specific removal operation in order to avoid or at least minimize damage to the pipe itself. More than one treatment per specific coating location can be utilized to effect complete removal of the coating. FIGS. 7*a* to 7*g*, described hereinafter, develop the multiple treatment method, and Table I, below, which shows the results of actual experimentation, provides at least an approximate relationship between pipe diameter, pipe wall thickness, coating thickness, charge size and charge spacing as pertains to the effectiveness of coating removal. The experiments referred to in Table I were performed at a depth of about six feet underwater and utilized the article of manufacture of this invention.

which is hereinafter referred to as a wrapper. The wrapper is fully described in FIGS. 2–6 below.

Referring now to FIG. 2, one embodiment of the wrapper is generally designated in the open, non-installed condition. The wrapper is generally comprised of a carrier means portion 3 and an attachment means portion 4. Carrier means portion 3 includes lower layer 5 and upper layer 6. Lower layer 5 can be any flexible, light weight material capable of being easily formed by hand to conform to the exterior of a conduit. The material of lower layer 5 should have sufficient mechanical strength, even when saturated with water, to resist punctures, tears and other such damage which could be occasioned by handling and installation. The currently preferred material for lower layer 5 is 15 ounce canvass. However, other material or synthetic woven and non-woven material exhibiting the above mentioned characteristics can be utilized.

Upper layer 6 is attached to lower layer 5 along attachment lines 7. As seen in FIG. 2, attachment lines 7 form enclosures 8 (see FIG. 6) defined on the bottom by lower layer 5, and on the top and sides by upper layer 6 and attachment lines 7. Attachment lines 7 are in fact the locus of points which define the various locations along which upper layer 6 is secured to lower layer 5. These locations can be a line of stitching, adhesion, staples, pins, buttons, snaps and the like. It is not even necessary that attachment lines 7 be continuous, as such lines can be formed by a series of spaced points. The importance of the method of attaching layers 5 and 6 together is that the one selected must insure the stability of the attachment during the rigors of handling and installation of the wrapper. The preferred method of attaching upper layer 6 to lower layer 5 is by stitching.

TABLE I

| STEEL PIPE DIAMETER | WALL THICKNESS | CONCRETE THICKNESS | MASTIC THICKNESS | EXPLOSIVE-FIRST SHOT | EXPLOSIVE-SECOND SHOT | RESULTS |
|---|---|---|---|---|---|---|
| 20" O.D. | 1/2 inch | 2-1/2 inches | 1/2 inch | 35 Strings 400 gr/ft- One per inch | 70 Strings 100 gr/ft- two per inch | 1. Concrete cracked on first shot. 2. Concrete completely removed on second shot. 3. Pipe slightly deformed. |
| 20" O.D. | 1/2 inch | 2-1/2 inches | 1/2 inch | 35 Strings 400 gr/ft- One per inch | | 1. Concrete cracked and chipped over complete circumference sufficient to allow removal after cutting wires and then prying. 2. Pipe slightly deformed. |
| 16" O.D. | .325 inch | 3 inches | 1/2 inch | 70 Strings 150 gr/ft- Two per inch | 70 Strings 100 gr/ft- Two per inch | 1. Concrete cracked and chipped over complete circumference on first shot 2. Pipe stripped bare of concrete and mastic on second shot. 3. Pipe very slightly deformed. |
| 18" O.D. | 9/32 inch | 3 inches | 3/16 inch | 70 Strings 100 gr/ft- Two per inch | 35 Strings 100 gr/ft- One per inch | 1. Concrete cracked and loosened on first shot. 2. Pipe stripped bare of concrete and mastic on second shot. 3. Bottom of pipe constricted as much as 1/4 inch. |
| 18" O.D. | 9/32 inch | 3 inches | 3/16 inch | 35 Strings 150 gr/ft- One per inch | 35 Strings 100 gr/ft- One per inch | 1. Concrete cracked and loosened over complete circumference and a portion fell off on first shot. 2. Pipe stripped bare of concrete and mastic on second shot. 3. Bottom of pipe constricted as much as 1/4 inch. |
| 18" O.D. | 9/32 inch | 3 inches | 3/16 inch | 35 Strings 100 gr/ft- One per inch Three-Quarter Circumference | 35 Strings 50 gr/ft- One per inch Three-Quarter Circumference | 1. Concrete fractured with one 2" crack all the way around the pipe on first shot. 2. Concrete shattered on second shot but retained by wire mesh. 3. Cutting wire mesh permitted concrete and mastic to fall off. 4. No dents or constriction of pipe. |

The explosive detonating cords utilized herein can be placed against the exterior of the coating to be removed in a single operation. This method of placement is enabled by the installation appliance of this invention Attachment lines 7 are preferred to be spaced about one inch apart. There is no known criticality concerning this spacing. As will be later discussed, separation of immediately adjacent explosive detonating cords has developed along one inch spacing. For example, see Table I, above.

The materials of construction of upper layer 6 can be the same as those described with respect to lower layer 5. The mechanical strength properties of the material utilized for upper layer 6 must be the same as those for lower layer 5 for the same reasons. In addition, the material utilized in upper layer 6 preferably has some elasticity to enable the insertion of detonating cords into enclosures 8 as shall be later explained. The currently preferred material of construction of upper layer 6 is a polyester double knit stretch fabric.

A series of slits 9 forming a single row are made in upper layer 6. The row of slits 9 are essentially perpendicular to attachment lines 7, wherein two slits are formed per each of the enclosures 8. The row of slits is preferably made approximately midway between the parallel with the edges of carrier means portion 3 of the wrapper. The specific location of the slits, however, is not critical and the reason for the preferred placement shall be clarified hereinafter.

Attached to lower layer 5 and in approximately a line drawn through and parallel with the row of slits 9 is tab 10 which has a hole 11 punched in the outer end thereof.

It may appear from the drawing of FIG. 2 that lower layer 5 consists merely of a narrow border surrounding upper layer 6. This is not so. The material of lower layer 5 completely underlies all of the material of upper layer 6. The drawing indicates upper layer 6 to be of slightly less dimension that lower layer 5. This is not a requirement. Both layers can have the same width and length dimensions.

It may also appear from the drawing of FIG. 2, when taken in connection with FIG. 6 (or FIGS. 4 or 5), that upper layer 6 is deliberately attached to lower layer 5 along attachment lines 7 in such a manner as to produce, by the attachment method itself, the gaps or void spaces shown in FIG. 6 which are denominated enclosures 8. This is not true. Upper layer 6 is attached to lower layer 5 while upper layer 6 is placed flatly and smoothly upon lower layer 5. Upon attachment, enclosures 8 are present but the gaps or void spaces shown in FIG. 6 are not created until the detonating cords are urged into enclosures 8 to thereby produce the separation of layers 5 and 6.

The entire wrapper, including in particular carrier means portion 3, is preferably rectangular in shape as is shown in FIG. 2.

Attachment means portion 4 of the wrapper, as seen in FIG. 2, consists of elastic bands 12 and slide fastener or zipper means 13 consisting of halves 13*a* and 13*b*. As seen more clearly when viewed in connection with FIG. 5, elastic bands 12 are attached, such as by stitching, to lower layer 5 on one edge and to slide fastener half 13*a* on the opposite edge. Elastic bands 12 are depicted as being attached to the under sides of layer 5 and fastener half 13*a* respectively. This is for drafting convenience only, the actual side of attachment is not relevant to the wrapper or to its use. Slide fastener half 13*b* is shown in FIG. 5 as being attached to the upper side of lower layer 5. This is for drafting convenience only; the actual side of attachment is not relevant to the wrapper or to its use.

Referring now to FIG. 3, another embodiment of the wrapper is generally designated in the open, non-installed condition. The wrapper is generally comprised of a carrier means portion 3 and an attachment means portion 4. All parts of carrier means portion 3, as shown in FIG. 3, are exactly the same as shown in FIG. 2. Accordingly, the parts of FIG. 3 which are identical to FIG. 2 bear the same reference numerals, thus, for descriptions of the parts of FIG. 3 identified by reference numerals 5–11, refer to the description of FIG. 2.

Attachment means portion 4 of FIG. 3 is referred to herein as a hook and loop fastener consisting of hook means 14 attached to one edge of lower layer 5 and loop means 15 attached to the opposite edge of lower layer 5.

One available hook and loop fastener system consists of two nylon tapes, one being covered with a multiplicity of stiff, nylon monofilaments formed into permanent hooks and the second being covered with soft, nylon loops. When the hooks and the loops are pressed together, they become embedded and attachment results. Hook and loop fasteners are marketed under the trademark VELCRO and are described in a number of U.S. Patents, including for example U.S. Pat. No. 2,717,437.

The slide fastener and elastic band attachment means shown in FIG. 2 and the hook and loop fastener attachment means shown in FIG. 3 each function satisfactorily to fasten carrier means portion 3 securely to the coating, such as coating 2, to be removed from a pipe. Of the wrappers shown in FIGS. 2 and 3, however, the embodiment shown in FIG. 3 is preferred. It has been found that the hook and loop fastener renders the wrapper of FIG. 3 more versatile in that a given sized carrier means portion 3 can be fitted to coated pipe of widely differing circumferences by merely varying the lengths of hook means 14. In contrast, a coated pipe having a circumference of only slightly greater than the width, that is, the distance from the outside edge of 13*b* to the outside edge of 13*a*, of the wrapper of FIG. 2 requires that elastic bands 12 be stretched in order to effect closure of the slide fastener 13. In underwater situations, divers can experience difficulty in stretching elastic bands 12 and thus in installing the wrapper of this invention. Installing the wrapper of FIG. 3 requires no stretching of members. Installation of the wrapper of FIG. 3 requires that the wrapper be placed against the pipe in an encircling manner and that hook means 14 be pressed against loop means 15 to effect closure. Providing hook means 14 of sufficient length for the coated pipe circumference involved can greatly simplify and ease underwater installation.

OPERATION

The operation of this invention shall be described in connection with the wrapper embodiment shown in FIG. 2; however, the operation does not differ substantially from that involved in connection with the wrapper embodiment shown in FIG. 3 and therefore the two are considered to be the same.

With the wrapper in the position indicated in FIG. 2, individual explosive detonating cords are inserted into enclosure 8. The enclosures maintain the individual cords in relatively fixed spaced relationship one to another and the cords are held in enclosures 8 due to the tendency of lower layer 5 and upper layer 6 to be biased toward each other, particularly when upper layer 6 is a material having elastic properties.

Attachment lines 7 are spaced one inch apart. Accordingly, where one explosive detonating cord is inserted into each enclosure 8, the explosive detonating cords are spaced about one inch apart. However, there is no requirement that there can be no more than one cord per enclosure, e.g. see Table I above, and there is no requirement that there be a cord inserted into each contiguous enclosure.

The length of each individual piece of explosive detonating cord inserted into enclosures 8 is primarily based upon the circumference of the coating to be removed. Accordingly, the length of each cord is in the range of about 67 to about 100 percent of the circumference of the pipe as coated.

A wrapper containing detonating cords equal in length to about 67 to about 75 percent of the circumference of the pipe as coated can effectively remove coatings from pipe installed underwater by placing the portion of the wrapper containing the explosive on top of the pipe and the portion thereof containing no explosive on the bottom of the pipe. Upon detonation the coating on the top of the pipe is broken by the explosion and the coating on the bottom of the pipe falls off.

The useful explosive loading of the detonating cords has been found to be in the range of about 50 to about 400 grains of explosive per lineal foot of explosive detonating cord based upon a one inch cord spacing. Thus, the useful explosive detonating cord contains in the range of about 50 to about 400 and preferably about 100 grains of explosive per lineal foot of cord per inch spacing.

The actual explosive loading of the cord utilized should not exceed about 400 grains per foot nor should it be less than about 50 grains per foot regardless of the loadings theoretically available pursuant to application of the explosive detonating cord use formula given above. This quantity of explosive can remove coatings which are in the range of about 2 to about 4 inches in thickness while avoiding substantial if any damage being done to the pipe.

The explosives useful herein are those normally recognized by those skilled in the explosives and blasting arts as being useful in detonating cords which are used to initiate commercial explosives. Detonating cord is also called exploding cord. It is a strong, flexible cord with a core containing an explosive. When detonating cord is initiated, it explodes along its entire length from the point of initiation at very high velocities in the range of about 18,000 to about 28,000 feet per second. One commercially available detonating cord which is useful herein has a detonating velocity of about 21,000 feet per second and is marketed under the registered trademark PRIMACORD. Examples of explosives having detonating velocities within the range listed which therefore render them candidates as the core of explosive material for detonating cords useful herein are set out in Table II below:

TABLE II

| EXPLOSIVE MATERIALS | | |
|---|---|---|
| Symbol | Chemical Name | Formula |
| RDX | Cyclotrimethylenetrinitramine, Hexahydro-1,3,5-Trinitro-5-Triazine, Cyclonite, Hexogen, T4 | $C_3H_6N_6O_6$ |
| PETN | Pentaerythrite Tetranitrate, Penta, Pentrit, Nitro Pentaerythrite | $C(CH_2NO_3)_4$ |

When the desired number of explosive detonating cords of desired length and loading have all been inserted into enclosures 8, then a single continuous length of detonating cord is placed against all of the cords in enclosures 8. This single length is utilized to initiate all the cords in enclosures 8. In order to place the initiating cord into contact with the detonating cords, the initiating cord is inserted into slits 9 in upper layer 6 such that the initiating cord penetrates into the interior of each of the enclosures 8 to thereby contact the detonating cords. Referring to FIG. 6, it is seen that initiating cord 16 penetrates each enclosure 8 via slits 9 formed therein to thereby contact each of the detonating cords 17 contained in enclosures 8.

When initiating cord 16 has been placed in contact with each of the detonating cords 17, then it is secured by any convenient method, such as by tying or knotting, to tab 10. This is done in order to avoid dislodging initiating cord 16 from slits 9 during subsequent handling and installation against pipe coating 2. Such dislodgement would place initiating cord 16 out of contact with detonating cords 17 which such contact is required for detonation of cords 17. Referring to FIG. 5, it is seen that cord 16 is inserted through hole 11 of tab 10 and then knotted.

It is preferred practice, although not a critical requirement, that each detonating cord 17 be initiated at approximately the mid-point of its length. Therefore, initiating cord 16 is preferably placed in contact with each detonating cord 17 at its approximate mid-point. In this connection, it was indicated above in the portion of this disclosure pertaining to the placement of slits 9 in upper layer 6 that slits 9 were preferably placed approximately midway between and parallel with the edges of carrier means portion 3 of the wrapper. With slits 9 thus centered in carrier means portion 3, assuming upper layer 6 to be centered on lower layer 5, then initiating cord 16 can be placed in contact with the mid-point of each of detonating cords 17 by merely placing each detonating cord 17 in its respective enclosure 8 such that about one half of its length is on one side of slits 9 in its respective enclosure 8 and about one half of its length is on the other side of slits 9.

With detonating cords 17 inserted into enclosures 8 and initiating cord 16 secured to tab 10 and inserted into slits 9 in such a fashion as to place it into contact with detonating cords 17, then the wrapper is prepared for installation against coating 2. FIG. 4 shows the embodiment of FIG. 2 installed as contemplated by this invention; accordingly, specific reference is now made to FIG. 4. Installation of the wrapper requires placing the bottom portion of lower layer 5 against the coating 2 to be removed, encircling the wrapper around the coated conduit such as pipe 1, bringing the extremities of attachment means portion 4, such as slide fastener half 13*a* and 13*b*, sufficiently close together to enable suitable connection thereof, and connecting the extremities of attachment means portion 4 together to secure the wrapper to the conduit.

As seen in FIGS. 4, 5 and 6, the wrapper of this invention as installed features: lower layer 5 against coating 2; detonating cords 17 encircling pipe 1 and coating 2 and lying in planes perpendicular to the axis of pipe 2; initiating cord 16 contacting detonating cords 17 and parallel with the axis of pipe 2; slide fastener 13 (or hook and loop fastener 14 and 15) in a connected positon; and the end of initiating cord 16 connected to tab 10.

FIG. 4 does not show that initiating cord 16 contacts the mid-points of detonating cords 17. The mid-point contact is preferred; however, the limitations of the perspective drawing (FIG. 4) require depiction of a less preferable installation in order to show all the various features of the wrapper of this invention as installed.

After the wrapper is installed as shown in FIG. 4, initiating cord 16 is attached to a suitable initiating means, such as a blasting cap, and thereafter the assembly can be detonated as is well understood by those skilled in the art. Any portion of initiating cord 16 can be connected to a suitable initiating means. The terminal connection indicated in FIG. 4 is shown for description and drafting convenience only.

Referring to FIGS. *7a–7g*, there is illustrated a series of steps which can be undertaken to remove a section of coated pipe from a pipeline wherein the wrapper of this invention is utilized to remove the coating adhering to those portions of the pipeline which are cut in order to remove the involved section of pipe.

Figure 7A:
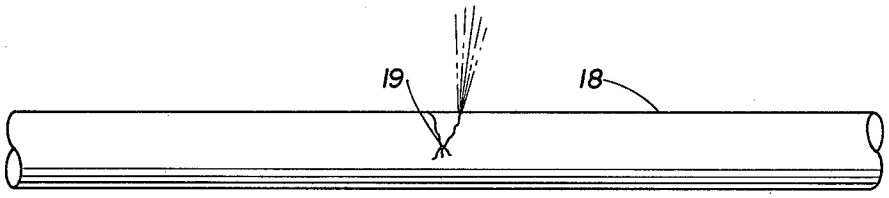
Figure 7B:
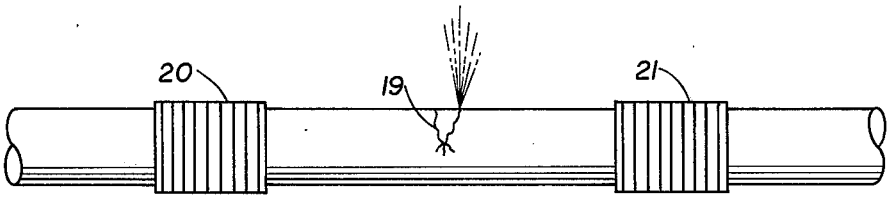
Figure 7C:
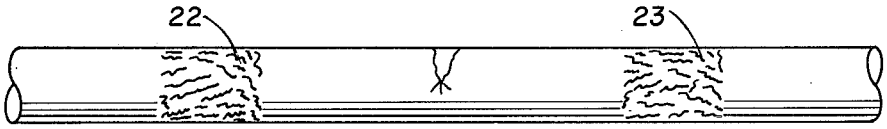
Figure 7D:
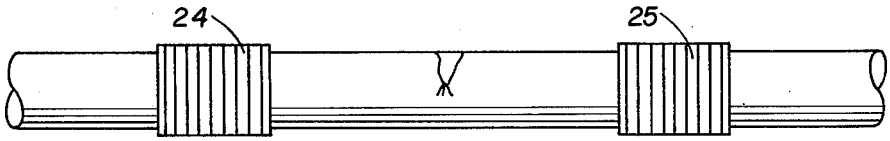
Figure 7E:
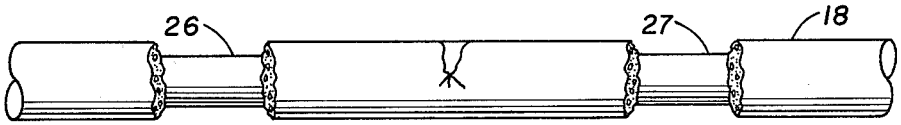
Figure 7F:
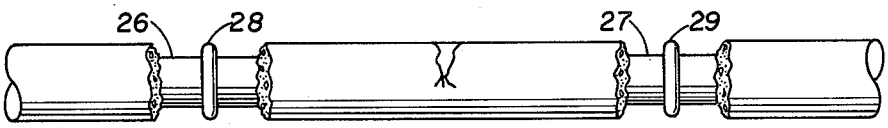
Figure 7G:
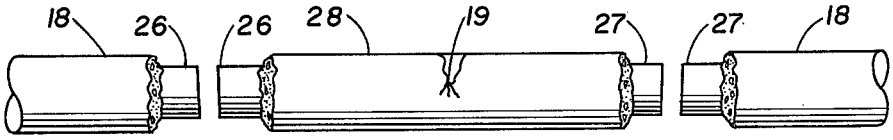

FIG. *7a* indicates concrete coated pipeline 18 containing an unsatisfactory section having a break 19. It is desired to remove the section having break 19 in order to facilitate repair of the pipeline. Accordingly, wrappers 20 and 21 of this invention, containing explosive detonating cords, as seen in FIG. *7b*, are installed on both sides of break 19. The explosives in wrappers 20 and 21 can be detonated substantially simultaneously to produce the results shown in FIG. *7c*. The concrete coating portions 22 and 23 under wrappers 20 and 21 are placed in stress or otherwise chipped and cracked by the first detonations but portions 22 and 23 are not removed. The explosive loadings of the cords utilized in wrappers 20 and 21 are deliberately designed to produce the results obtained in FIG. *7c* in order to avoid distortion of the metal underlying portions 22 and 23. Wrappers 24 and 25 of this invention containing explosive detonating cord, as seen in FIG. 7d, are installed on both sides of break 19 over concrete coating portions 22 and 23 respectively. The explosive loadings of the cords utilized in wrappers 24 and 25 can be less than those utilized in wrappers 20 and 21. The explosives in wrappers 24 and 25 can be detonated substantially simultaneously to produce the results shown in FIG. *7e*. (Compare with the data provided in Table I above.) The concrete coating portions 22 and 23 are removed by the detonation leaving exposed bare metal portions 26 and 27 of pipeline 18. Pipeline 18 is not damaged.

As seen in FIG. *7f*, circular cutters 28 and 29 comprising linear shaped charges are attached to bare metal portions 26 and 27 respectively. Upon actuation of cutters 26 and 27, bare metal sections 26 and 27 are cut thus severing section 28 containing break 19 from pipeline 18 to permit the convenient removal of section 28 from pipeline 18.

The explosive loading of the detonating cords utilized in wrappers 20 and 21 of FIG. *7b* could be increased sufficiently to produce the results indicated in FIG. *7e*, thus eliminating the condition shown in FIG. *7c* and the intermediate step shown in FIG. *7d*. In this regard see Table I above. However, increasing the initial charge size in order to avoid use of a second set of charges can result in damage to bare metal portions 26 and 27 with consequent difficulty in proper functioning of cutters 28 and 29.

The following examples are provided to further illustrate the operation of this invention; however, the scope of the invention is not limited to the descriptions and results recited therein.

EXAMPLE 1

A wrapper as described in FIG. 2 was loaded with 35 rows of detonating cord containing 400 grains of PETN per lineal foot of cord set on one inch centers. The detonating cords completely encircled a 20 inch O.D. pipe having a one-half inch wall which was coated with one-half inch of semastic and 2 ½ inches of concrete. The test was conducted in water at a depth of 6 feet below the water surface. The detonation caused the concrete and semastic to crack and chip to such an extent that it is believed that a diver could complete the removal of the coating without undue effort. The explosion caused a slight denting of the pipe.

EXAMPLE 2

A wrapper as described in FIG. 2 was loaded with 35 rows of detonating cords set on one inch centers. Each row consisted of two cords, and each cord contained 150 grains of PETN per lineal foot of cord. The detonating cords completely encircled a 16 inch O.D. pipe having a 5/16 wall and covered with a coating consisting of ½ inch of semastic and 3 inches of concrete. The test was conducted in water at a depth of 6 feet below the water surface. Upon detonation, the concrete and semastic were chipped and cracked to such an extent that it is believed that a diver could complete the removal of the coating without undue effort.

EXAMPLE 3

A wrapper as described in FIG. 2 was loaded with 35 rows of detonating cords set on one inch centers. Each row consisted of two cords, and each cord contained 100 grains of PETN per lineal foot of cord. The wrapper was installed on the same 16 inch pipe described in Example 2 over the same coated area treated by the explosives utilized in Example 2. The cords utilized in this example completely encircled the coated pipe. The test was conducted in water at a depth of 6 feet below the water surface. Upon detonation, the previously cracked and chipped coating was completely removed from the pipe leaving the bare steel. The two treatments caused a slight denting of the pipe.

Having described my invention, that which is claimed is:

1. A process for removing a selected section of a fracturable coating from the exterior surface of a conduit comprising:

a. selecting a coating removal zone consisting of a section of a sheath of fracturable coating formed on the exterior surface of a conduit;

b. placing a plurality of spaced explosive detonating cords against at least a portion of the peripheral surface of said sheath within said coating removal zone;

c. detonating said explosive detonating cords whereby cracks and fractures are produced in the portion of said sheath against said plurality of explosive detonating cords, wherein said cracks and fractures are in sufficient number to permit subsequent removal of said coating from said coating removal zone without substantially damaging said conduit; and d. removing said cracked and fractured portions of said coating from said coating removal zone.

2. The process of claim 1 wherein said conduit is a pipeline, part of which is installed underwater, and said sheath covers the portion of said pipeline which is installed underwater.

3. The process of claim 2 wherein all of said plurality of spaced explosive detonating cords are placed against said sheath in a single operation.

4. The process of claim 3 wherein said plurality of spaced explosive detonating cords are maintained in said spaced relationship by an installation appliance comprised of a carrier means portion and an attachment means portion;

wherein said carrier means portion includes a lower layer suitably attached to an upper layer whereby a plurality of spaced enclosures for holding said cords in said spaced relationship are formed between said lower layer and said upper layer, and wherein said attachment means portion, attached to said carrier means portion, maintains said installation appliance in fixed position against said sheath.

5. The process of claim 4 wherein said plurality of spaced enclosures are in substantially parallel relationship one to another, and further wherein said enclosures are formed such that upon attachment of said installation appliance to said sheath, said enclosures lie in planes substantially perpendicular to the axis of said pipeline.

6. The process of claim 5 wherein said lower layer is selected from material or synthetic woven or nonwoven flexible, light-weight material capable of being applied by hand to conform to the periphery of said sheath and has sufficient mechanical strength to resist punctures, tears and similar such damage.

7. The process of claim 6 wherein said upper layer is selected from materials having properties similar to those of said lower layer and which is also characterized as having at least some elasticity.

8. The process of claim 7 wherein said lower layer is canvas and said upper layer is a double knitted fabric having elastic properties.

9. The process of claim 8 wherein said explosive detonating cords contain in the range of about 50 to about 400 grains of explosive per lineal foot of cord per inch of spacing.

10. The process of claim 9 wherein said explosive is selected from PETN and RDX.

11. The process of claim 10 wherein the length of each explosive detonating cord in said plurality of detonating cords is in the range of about 67 to about 100 percent of the circumference of said sheath.

12. The process of claim 11 wherein the nominal diameter of said pipeline is in the range of about 12 to about 48 inches and the thickness of said fracturable coating is in the range of about 2 to about 4 inches.

13. The process of claim 12 wherein said fracturable coating comprises concrete.

14. The process of claim 13 wherein said attachment means portion is selected from slide fastening means and hook and loop fastening means.

15. The process of claim 14 wherein said removing step (d) comprises repeating said placing step (b) and said detonating step (c) until said coating is removed from said coating removal zone.

16. An article of manufacture for removing a fracturable coating from a conduit comprising a carrier means portion, an attachment means portion, and a plurality of explosive detonating cord segments;

said carrier means portion includes a lower layer of flexible material attached to an upper layer of flexible material whereby a plurality of spaced enclosures are formed between said lower layer and said upper layer, said attachment means portion is attached to said carrier means portion and maintains said article in fixed position when installed on said conduit, and said explosive detonating cords are maintained in said enclosures.

* * * * *